US011855399B1

(12) United States Patent
Gretz

(10) Patent No.: US 11,855,399 B1
(45) Date of Patent: Dec. 26, 2023

(54) GROUNDING BUSHING INSTALLABLE TO RACEWAY BEFORE OR AFTER WIRES ARE IN THE RACEWAY

(71) Applicant: Arlington Industries, Inc., Scranton, PA (US)

(72) Inventor: Thomas J. Gretz, Delray Beach, FL (US)

(73) Assignee: Arlington Industries, Inc., Scranton, PA (US)

( * ) Notice: Subject to any disclaimer, the term of this patent is extended or adjusted under 35 U.S.C. 154(b) by 458 days.

(21) Appl. No.: 17/209,527

(22) Filed: Mar. 23, 2021

Related U.S. Application Data

(60) Provisional application No. 62/993,753, filed on Mar. 24, 2020.

(51) Int. Cl.
*H01R 4/64* (2006.01)
*H01R 13/655* (2006.01)
*H01R 13/512* (2006.01)

(52) U.S. Cl.
CPC ..... *H01R 4/643* (2013.01); *H01R 13/512* (2013.01); *H01R 13/655* (2013.01)

(58) Field of Classification Search
None
See application file for complete search history.

(56) References Cited

U.S. PATENT DOCUMENTS

| | | | | | |
|---|---|---|---|---|---|
| 2,116,776 | A * | 5/1938 | Bondeson | H01R 4/643 | 439/811 |
| 3,988,052 | A * | 10/1976 | Mooney | H01R 4/46 | 439/814 |
| 6,840,782 | B1 * | 1/2005 | Borden | H01R 4/643 | 439/92 |
| 6,976,857 | B1 * | 12/2005 | Shukla | H01R 9/2483 | 439/100 |
| 8,231,392 | B2 | 7/2012 | Garvin | | |
| 8,419,449 | B1 | 4/2013 | Smith | | |
| 9,012,791 | B2 | 4/2015 | Smith | | |
| 10,109,932 | B2 * | 10/2018 | Trombley | H01R 4/643 | |
| 10,461,443 | B2 | 10/2019 | Smith | | |
| 10,784,600 | B1 * | 9/2020 | Smith | H01R 11/26 | |
| 2013/0025905 | A1 * | 1/2013 | Garvin | H01R 4/643 | 439/775 |
| 2013/0133943 | A1 * | 5/2013 | Smith | H01R 4/64 | 174/665 |

* cited by examiner

*Primary Examiner* — Hoa C Nguyen
*Assistant Examiner* — John B Freal

(57) ABSTRACT

A grounding bushing with a central opening for electrically grounding a conduit, electrical metal tubing (EMT), or a pipe. The grounding bushing includes a stationary bushing portion and a rotatable bushing portion having slotted ends held together by mounting fasteners. The slotted ends permit rotation of the rotatable bushing portion away from the stationary bushing portion. After attachment to a conduit or similar structure, one or more mounting fasteners can be loosened to allow installation of additional wires through the central opening and into the conduit, EMT, or pipe. An electrically insulated liner extending around the entire inner periphery of the bushing prevents chafing or abrasion of any electrical wires by the end of the conduit.

16 Claims, 9 Drawing Sheets

GROUNDING BUSHING INSTALLABLE TO RACEWAY BEFORE OR AFTER WIRES ARE IN THE RACEWAY

CROSS-REFERENCE TO RELATED APPLICATIONS

This application claims the benefit of Provisional U.S. Patent Application Ser. No. 62/993,753 filed Mar. 24, 2020, the contents of which are incorporated herein by reference in their entirety.

FIELD OF THE INVENTION

The present invention generally relates to an electrical grounding device, and, more specifically to a grounding bushing for installation to a raceway before or after wires are in the raceway.

BACKGROUND OF THE INVENTION

According to local electrical codes, the electrical systems of a structure must be grounded to earth. Grounding bushings are typically used to ground raceways and conduit to provide a path to zero potential.

Collar-type bushings are typically installed during initial installation of the electrical system, during which wires are installed within the collar of the bushing. The collar-type bushings may include lugs for grounding the bushing itself.

It is often necessary, after initial installation, to completely remove the collar-type bushing in order to install additional wires through the bushing to ground electrical systems which were not present at initial installation. To overcome this problem, several types of grounding bushings have been proposed. One type of conventional bushing is a grounding bushing that is an assembly of two bushing portions hinged together at one end by a hinge pin and fastened together at the opposing end by a screw. Unfortunately, the hinged assembly and not easily removed from the conduit as the screw must be completely removed from one end of the assembly and the opposing end must be rotated radially outward around the hinge pin in order to provide complete access to the conduit opening. It is then cumbersome to manipulate the hinged assembly onto the conduit again.

Other conventional bushings include two bushing portions having bores and associated screws on both ends of the bushing portions. This type of bushing is also difficult to remove entirely from the conduit as both screws must be totally removed in order to remove the bushing from the conduit. Another disadvantage of both of these conventional bushings is that it is easy to drop, lose, or misplace one or both screws, thereby hampering easy reassembly and installation of the bushing.

Accordingly, what is needed is a grounding bushing that is easily and completely removable from a conduit and can be easily reinstalled on the conduit without the loss of one or more fasteners and which furthermore is not a hinged assembly.

Additionally, the bushing should include an inner liner for preventing chafing or abrasion of electrical cables by the edges of the pipe or conduit. The bushing should be capable of being installed on the ends of pipe and conduit after initial installation of the electrical cables therein, and should be capable of passing an Underwriters Lab grounding test. The device should provide a non-abrasive surface for protecting installed electrical cables and wires from direct contact with the cut edges of pipes or conduit, should cover the entirety of the periphery of the conduit edge to which it is attached, and must be capable of being tightly secured to the pipe or conduit in order to meet the UL grounding requirements.

BRIEF SUMMARY OF THE INVENTION

The current invention is a grounding bushing with a central opening for electrically grounding a conduit, electrical metal tubing (EMT), or a pipe. The grounding bushing includes a stationary bushing portion and a rotatable bushing portion having slotted ends held together by mounting fasteners. The slotted ends permit rotation of the rotatable bushing portion away from the stationary bushing portion. After attachment to a conduit or similar structure, one or more mounting fasteners can be loosened to allow installation of additional wires through the central opening and into the conduit, EMT, or pipe. An electrically insulated liner extending around the entire inner periphery of the bushing prevents chafing or abrasion of any electrical wires by the end of the conduit.

OBJECTS AND ADVANTAGES

A first object of the invention is to provide a grounding bushing with a rotatable portion that can be rotated away from the installed bushing or easily removed from an electrical conduit after electrical cables have been installed in the conduit in order to permit insertion of additional wires within the conduit.

A further object is to provide a grounding bushing that is easily and completely removable from a conduit and can be easily reinstalled on the conduit without the loss of one or more fasteners.

Another object is to reduce manufacturing cost of a grounding bushing by providing a grounding bushing which does not require a hinged assembly.

A further object is to provide an inner liner to prevent chafing or abrasion of electrical cables by the end or edges of the pipe or conduit.

A further object of the grounding bushing is to provide a means for tightly securing it to the pipe or conduit in order to meet the UL grounding requirements.

These and further objects and advantages will become clear when reading the detailed description along with reference to the associated drawings.

BRIEF DESCRIPTION OF THE SEVERAL VIEWS OF THE DRAWING(S)

Reference is made herein to the accompanying drawings, which are not necessarily drawn to scale, and wherein.

DETAILED DESCRIPTION

Figure 1:
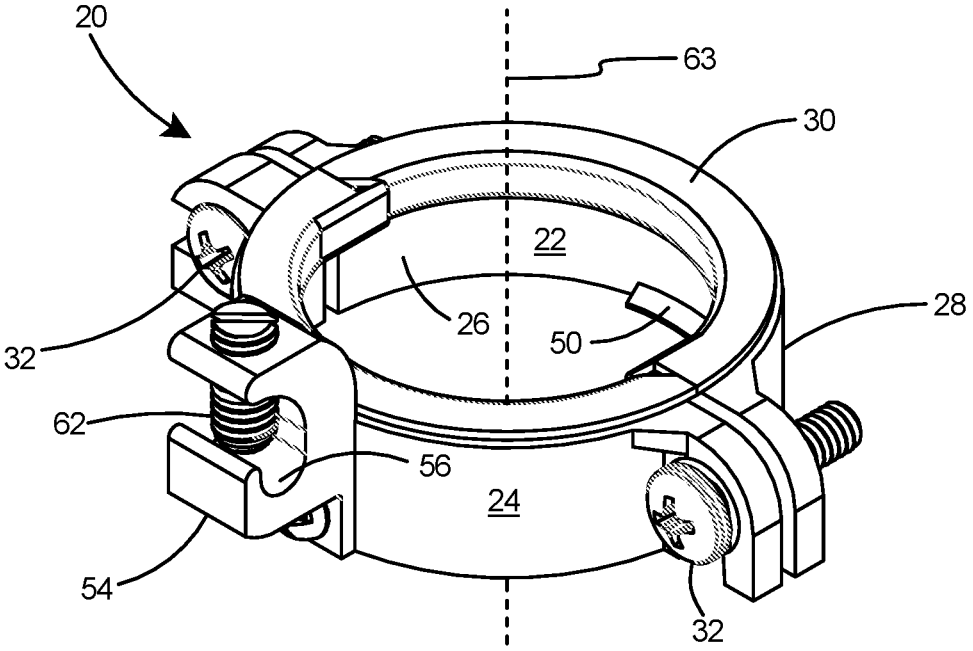
FIG. 1 is a top isometric view of a first embodiment of a split grounding bushing assembly in accordance with embodiments of the invention.

With reference to FIG. 1, the present invention is a grounding bushing 20 for securing a ground wire to a pipe or similar structure. The grounding bushing 20 is a grounding bushing with two substantially semi-circular bushing portions, including a stationary bushing portion 22 and a rotatable bushing portion 24 each having an inner periphery 26 and an outer periphery 28. A liner 30 is placed within and substantially covers the inner periphery 26 of each bushing portion 22, 24. Mounting fasteners 32 provide a means of securing the two bushing portions together.

Figure 2:
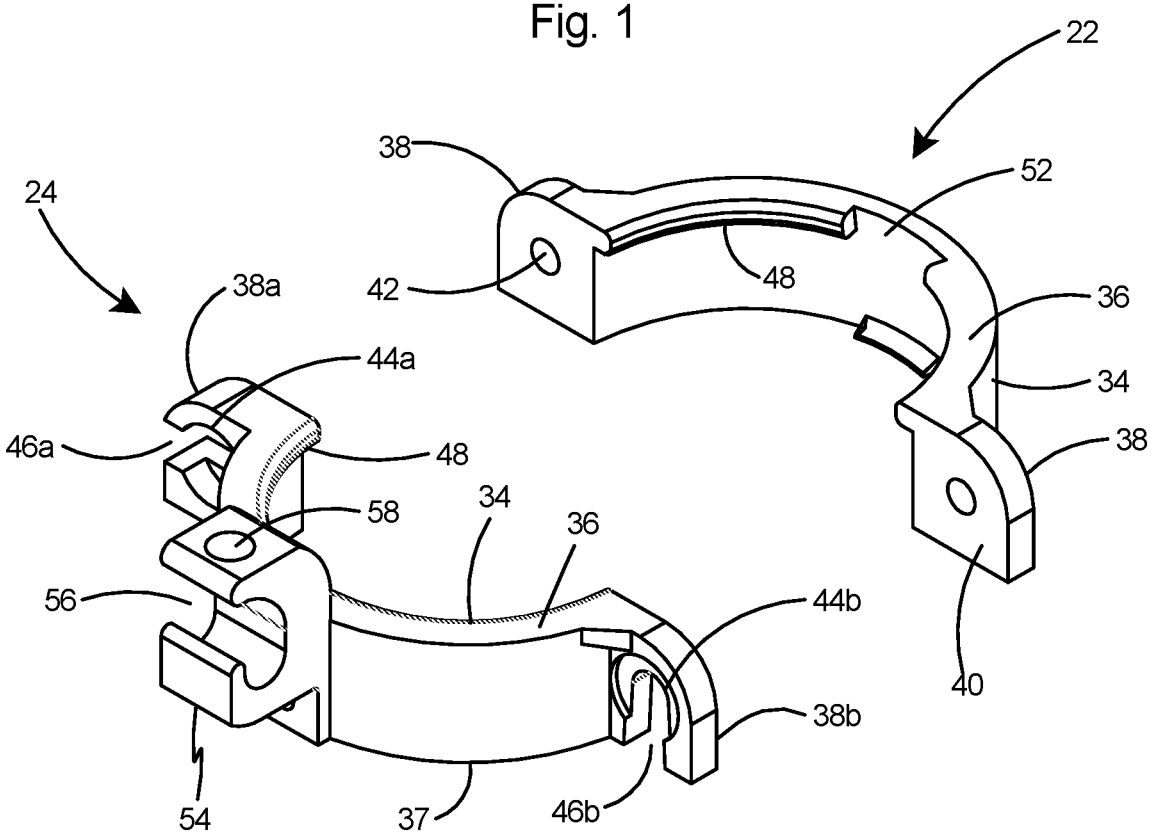
FIG. 2 is a top isometric view of two bushing portions that form a portion of the split grounding bushing of FIG. 1.
Figure 3:
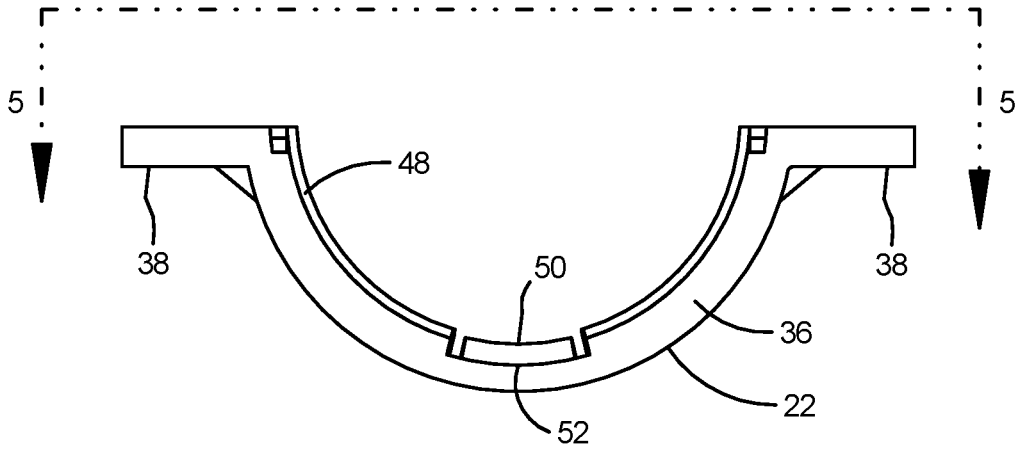
FIG. 3 is a top view of the stationary bushing portion of the grounding bushing.

Referring to FIGS. 1 and 2, the stationary bushing portion 22 and rotatable bushing portion 24 each include an arcuate body 34 having a top edge 36, a bottom edge 37, and two ends 38 having planar mating surfaces 40. Ends 38 of stationary bushing portion 22 include apertures 42 therein. A first end 38*a* of rotatable bushing portion 24 includes a slot 44*a* with a slot opening 46*a* facing radially outward from the outer periphery 28 of the rotatable bushing, with slot 46*a* being orthogonal with respect to the central axis. A second end 38*b* of rotatable bushing portion 24 includes a slot 44*b* having a slot opening 46*b* facing the bottom edge 37 of the rotatable bushing, with slot 46*b* being parallel with respect to the central axis. The orientation of the slot openings 46*a* and 46*b* are critical features of the invention that enable opening of the assembled bushing 20 by rotation of the rotatable bushing portion 24 with respect to the stationary bushing portion 22. For the bushing assembly 20, slight loosening of mounting fastener 32 at the second end 38*b* of rotatable bushing portion 24 will enable rotation of the rotatable bushing 24 with respect to the stationary bushing portion 22.

The stationary bushing portion 22 and rotatable bushing portion 24 each include a lip 48 extending along their inner peripheries 26. Stationary bushing portion 22 includes an integral tooth 50 on its inner periphery 26 and a notch 52 in its lip 48, with the notch 52 being substantially in axial alignment with the tooth 50. An integral lug 54 is provided on the rotatable bushing portion 24. The integral lug 54 includes a grounding conductor opening 56 and a bore 58.

With reference to FIG. 1, after assembly into the grounding bushing assembly 20, mounting fasteners 32 secure the two ends 38 of the bushing portions 22, 24 together with their respective liners 30 therein and a set screw 62 extends through the lug 54 and into the grounding conductor opening 56. Set screw 62 is parallel to the axial center 63 of the bushing assembly 20.

Figure 4:
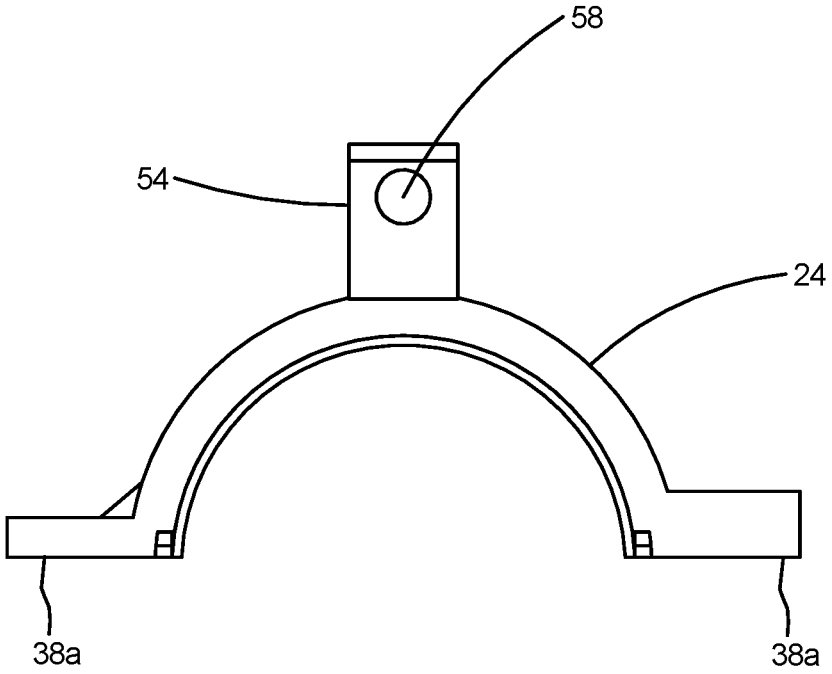
FIG. 4 is a top view of the rotatable bushing portion of the grounding bushing.

As shown in FIG. 4, the first end 38*a* of the rotatable bushing portion 24 is thicker than the second end 38*b*. When the bushing is fully assembled, the thicker first end 38*a* enables an installer to slightly loosen the mounting fastener on the second, thinner end 38*b*, thereby enabling the installer to rotate the thinner second end 38*b* away from the bushing assembly and enabling the second end 38*b* to rotate away from the stationary bushing portion 22.

Figure 5:
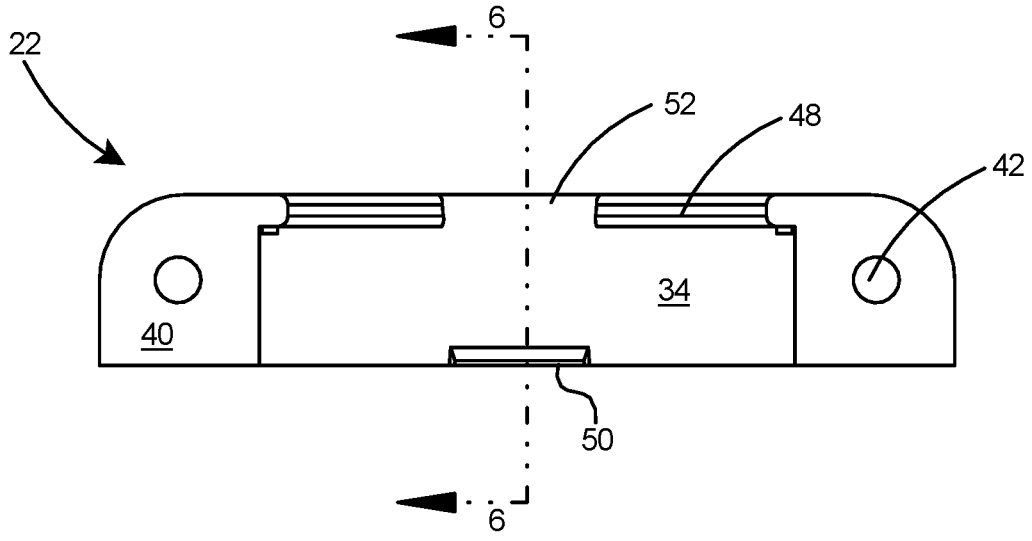
FIG. 5 is a view of the stationary bushing portion taken along line 5-5 of FIG. 3.
Figure 6:
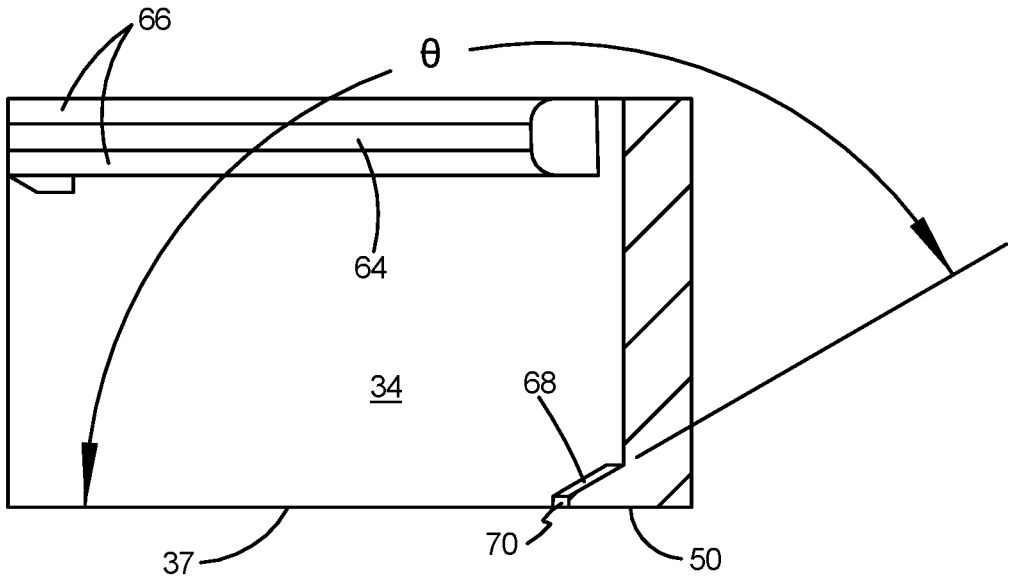
FIG. 6 is a sectional view of the stationary bushing portion taken along line 6-6 of FIG. 5.
Figure 7A:
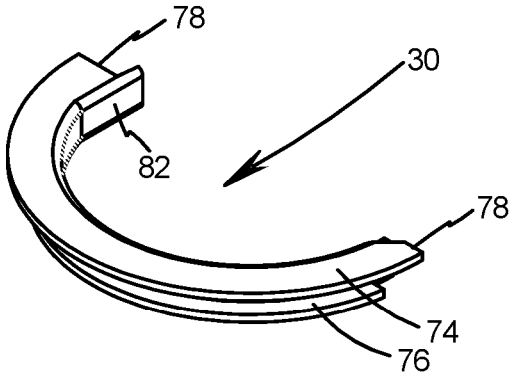
FIG. 7A is a top isometric view of a liner that forms a portion of the grounding bushing assembly FIG. 1.
Figure 8:
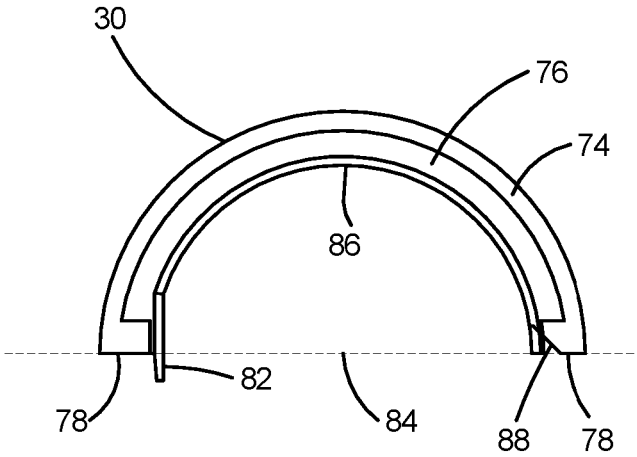
FIG. 8 is a bottom view of the liner.
Figure 7B:
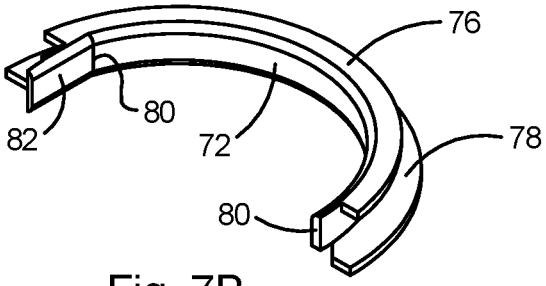
FIG. 7B is a bottom isometric view of the liner.
Figure 9:
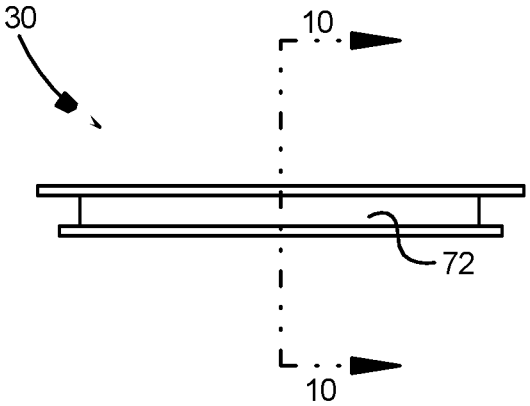
FIG. 9 is a side view of the liner.
Figure 10:
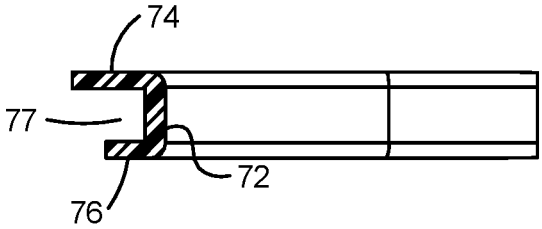
FIG. 10 is a sectional view of the liner taken along line 10-10 of FIG. 9.

Referring to FIGS. 5 and 6, the tooth 50 and the notch 52 of the stationary bushing portion 22 are substantially in axial alignment. Lip 48 preferably includes a flat central portion 64 and two outer arcuate portions 66. Tooth 50 extends from the body 34 of the stationary bushing portion 22 and includes a sloped upper surface 68 and a sharp edge 70. The sharp edge 70 enables the bushing assembly (not shown), when tightened upon a threaded or rigid conduit, to bite into the outer surface or threads of the conduit and better grip the conduit. The sloped upper surface 68 is preferably at an angle θ of between 140 and 160 degrees with respect to the bottom edge 37 of the stationary bushing portion 22.

With reference to FIGS. 7A-10, liner 30 includes a liner body 72 with a top flange 74 and a bottom flange 76 defining a gap 77 there between, with top flange 74 extending to a greater distance than the bottom flange 76. The top flange 74 includes two ends 78 that are diametrically opposed to one another. Liner body 72 includes two ends 80 a tab 82 extending from a first of the ends 80. The two ends 78 of the top flange 74 reside in a plane 84 and tab 82 extends beyond the plane 84. The tab 82 angles inward from the inner circumference 86 of the liner body 72 and a notch 88 is provided on the opposing end 80 of the liner body. Notch 88 enables the tab 82 of the mating liner to ride over sloped surface and cover the joints of the mated liners 30 when fitted together in the bushing assembly.

Figure 11:
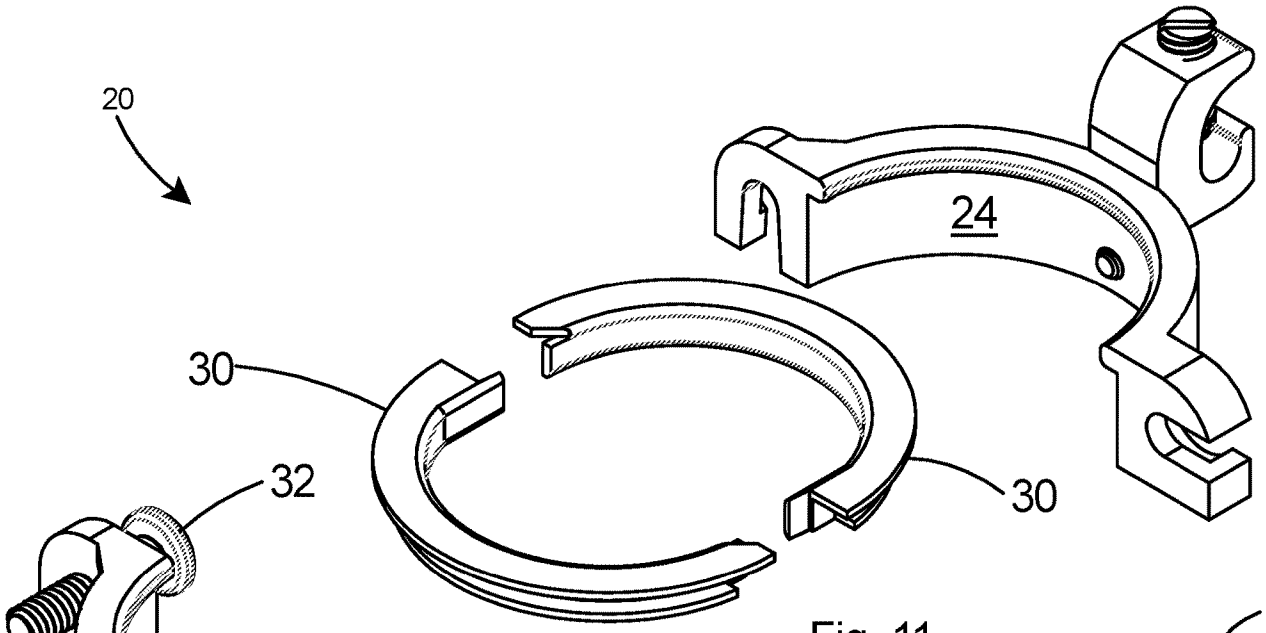
FIG. 11 is an exploded isometric view of the grounding bushing assembly of FIG. 1.
Figure 12:
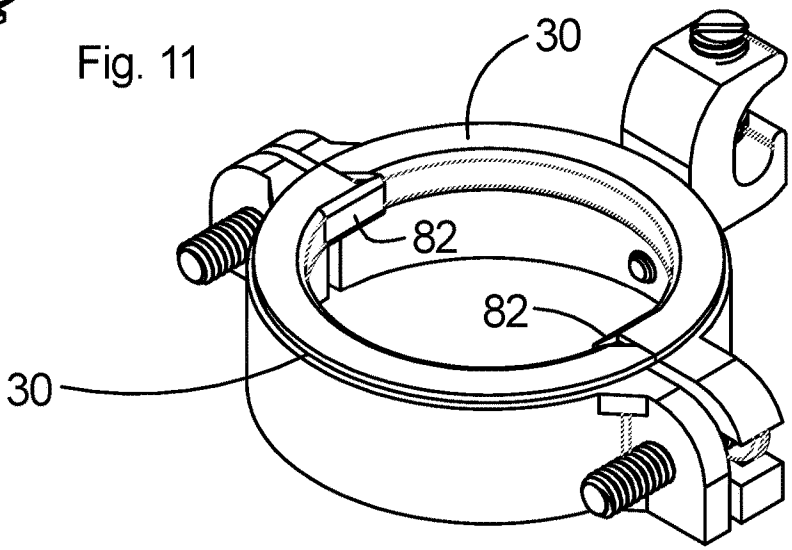
FIG. 12 is a top isometric view of the finished installation of the fully assembled grounding bushing of FIG. 11.

Referring to FIG. 11, there is shown an alignment of the various portions of the grounding bushing 20 prior to assembly, including the stationary bushing portion 22, the rotatable bushing portion 24, two insulating liners 30, and the mounting fasteners 32. In the assembled bushing as shown in FIG. 12, the insulating liners 30 with their tabs 82 will cover and insulate the entire top surface and inner periphery 26 of the bushing portions 22, 24.

Figure 14:
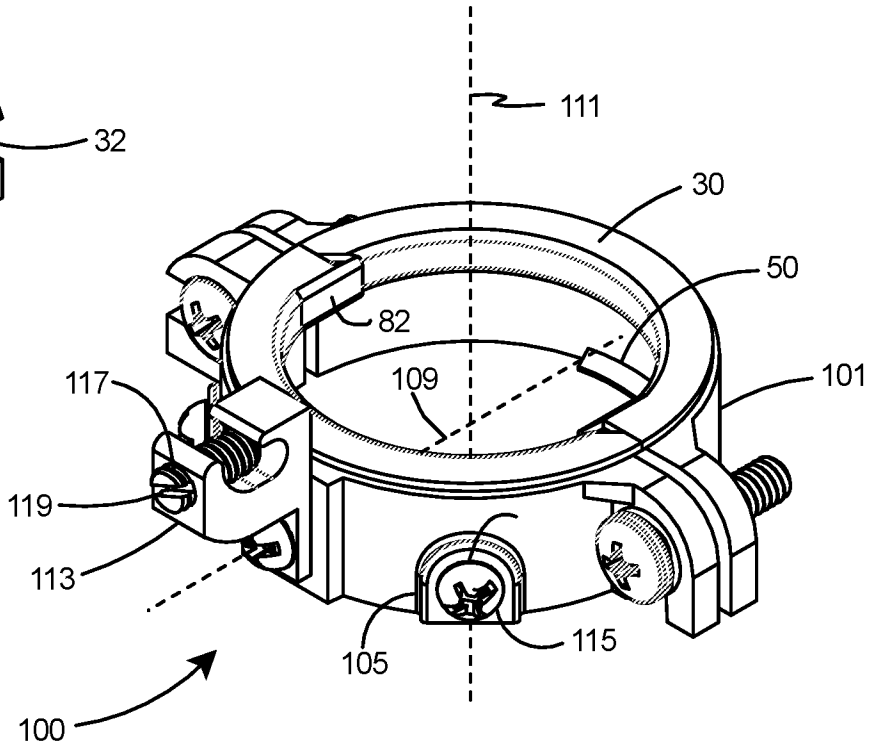
FIG. 14 is a bottom isometric view of the fully assembled grounding bushing of FIG. 13.
Figure 13:
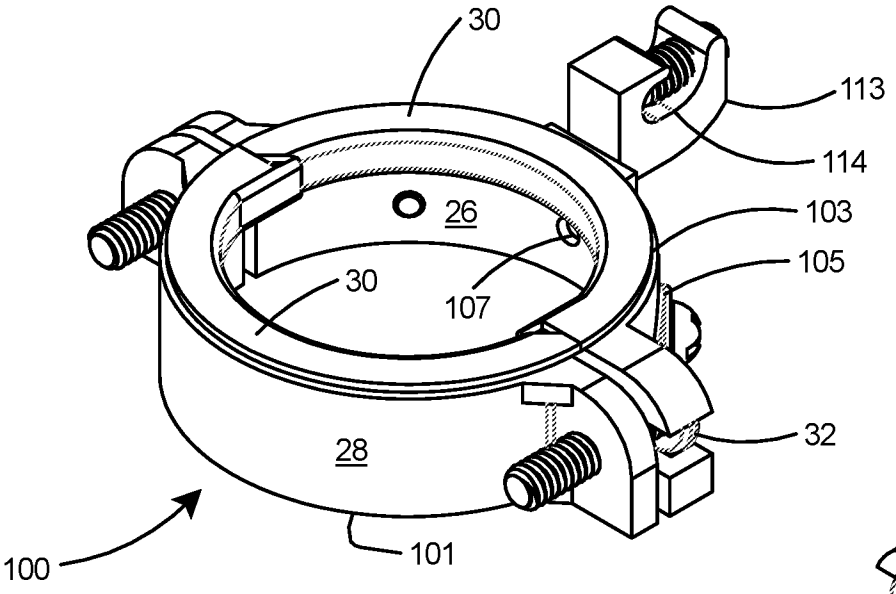
FIG. 13 is a top isometric view of a second and preferred embodiment of a split grounding bushing assembly in accordance with embodiments of the invention.
Figure 15:
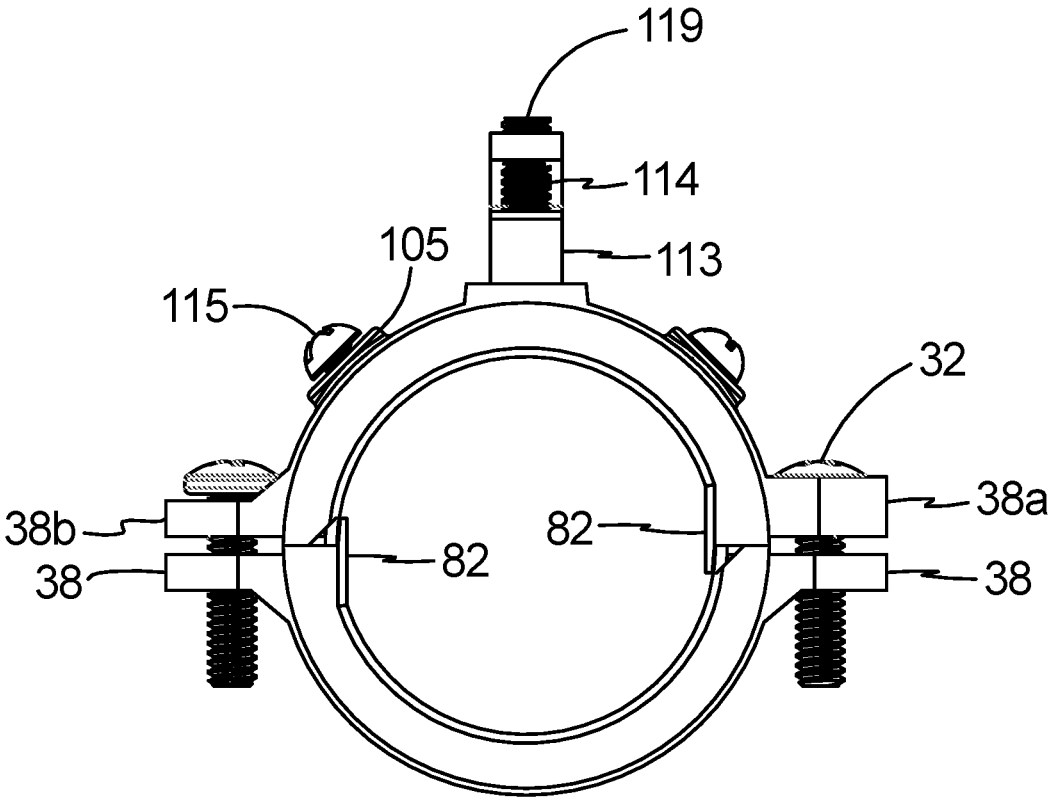
FIG. 15 is a plan view of the grounding bushing of FIG. 13.
Figure 16:
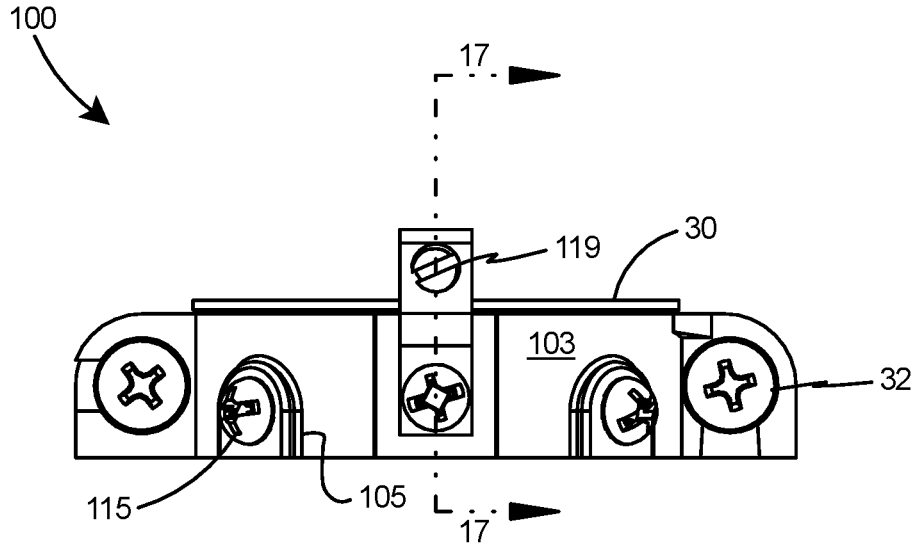
FIG. 16 is a side view of the grounding bushing as viewed from the top side of FIG. 15.
Figure 17:
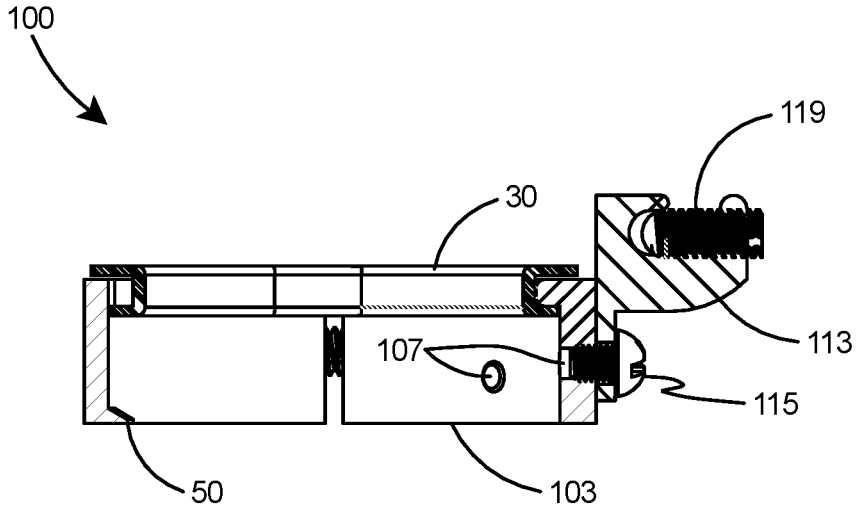
FIG. 17 is a sectional view of the grounding bushing taken along line 17-17 of FIG. 16.

With reference to FIGS. 13 and 14, there is shown a second and preferred embodiment of a grounding bushing 100 for securing a ground wire to a pipe or similar structure. The split grounding bushing 100 includes two substantially semi-circular bushing portions, including a stationary bushing portion 101 and a rotatable bushing portion 103 each having an inner periphery 26 and an outer periphery 28. A liner 30 is fitted within and substantially covers the inner periphery 26 of each bushing portion 101, 103. Mounting fasteners 32 provide a means of securing the two bushing portions together.

The rotatable bushing portion 103 of the second embodiment includes two or more lug mounts 105 at various positions on the outer periphery 28 of the rotatable bushing portion 103. The lug mounts 105 include apertures 107 therein which include axes 109 that are orthogonal to the central axis 111 of the grounding bushing 100. A lug 113 may be secured to any one of the lug mounts 105 on the outer periphery 28 of the rotatable bushing portion 103. The multiple lug mounts 105 enable an installer to select the positioning of the lug 113 on the exterior of the bushing 100, enable repositioning of the lug 113 at any time, or enable installing one or more additional lugs to the bushing. Lug screws 115 secure the lug 113 to the rotatable bushing portion 103. The lug 113 includes a grounding conductor opening 114 and a bore 117 orthogonal to central axis 111 of the grounding bushing 100. A set screw 119 extends through the lug 113 and into the grounding conductor opening 114. Set screw 119 is orthogonal to the central axis 111 of the bushing assembly 100. Although screw 119 is described as a set screw herein, it can be any type of screw for securing a ground wire to the grounding lug.

Figure 19:
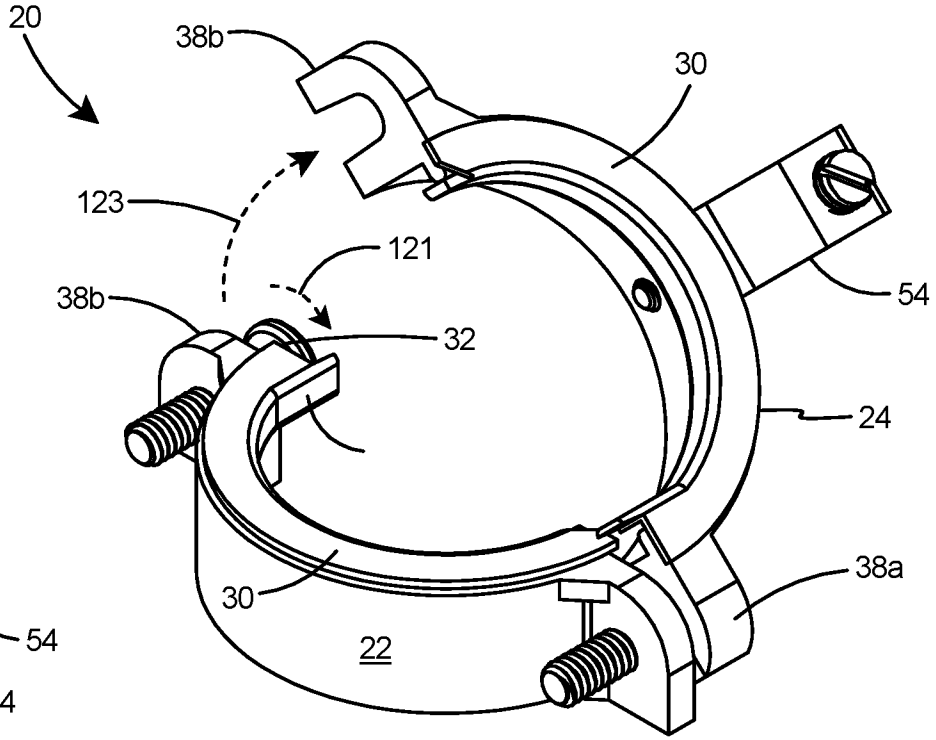
FIG. 19 is an isometric view of the first embodiment of the rotatable bushing portion in an open configuration.
Figure 18:
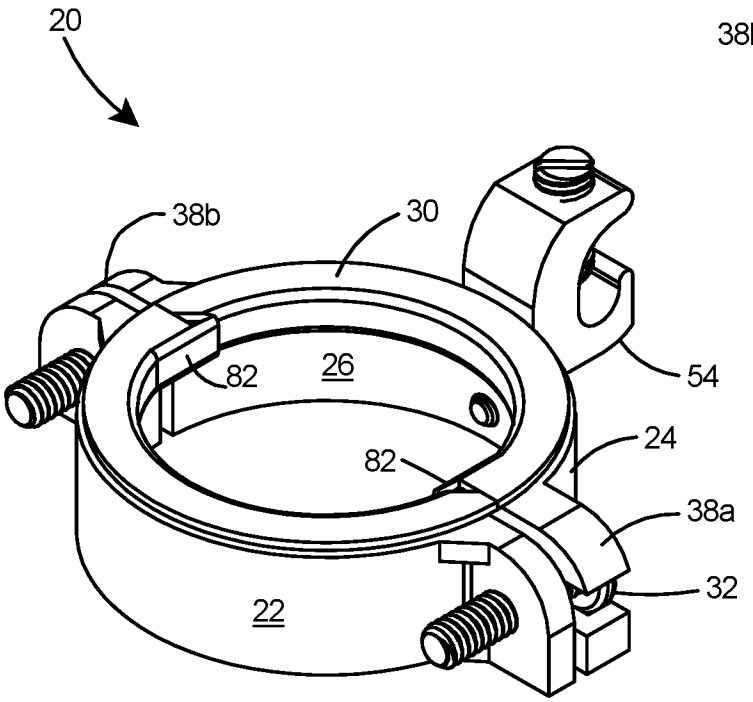
FIG. 18 is an isometric view of the first embodiment of the rotatable bushing portion in a closed configuration.

With reference to FIGS. 18, there is shown a grounding bushing 20 in a closed configuration, in which the stationary bushing portion 22 and the rotatable bushing portion 24 are secured together by mounting fasteners 32 at the two ends 38. As shown in FIG. 19, the grounding bushing 20 can be reconfigured to the open configuration by simply loosening the mounting fastener 32 on the second, thinner end 38*b* as indicated by directional arrow 121, thereby enabling the installer to rotate the rotatable bushing portion 24, as indicated by directional arrow 123, away from the stationary bushing portion 22. The easy-opening feature of the bushing assembly enables a user to reopen or reclose the bushing assembly as needed to enable slipping more conductors into the pipe. In the closed configuration, the insulating liners 30 with their integral tabs 82 will cover and insulate the top surface and the entire inner periphery 26 of the bushing portions 22, 24.

Preferably, the stationary bushing portion 22 and the rotatable bushing portion 24 are electrically conductive. Most preferably, the bushing portions 22 and 24 are constructed of metal Preferably, the liners 30 are electrically insulating. Most preferably, the liners 30 are constructed of nylon.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A grounding bushing comprising:

a substantially ring-shaped body including a stationary bushing portion and a rotatable bushing portion each having two ends, said ring-shaped body including a ring opening;

said stationary bushing portion including threaded bores on each end;

said rotatable bushing portion including a bottom edge, a first slot on said first end and a second slot on said second end, said slots having a slot opening;

a mounting fastener extending through each of said slots on said ends of said rotatable bushing portion and threaded into said threaded bores of said stationary bushing portion; and said first end of said rotatable bushing portion is thicker than said second end of said rotatable bushing portion.

2. The grounding bushing of claim 1, comprising:

said first slot on said first end of said rotatable bushing portion orthogonal to the axial center of said ring-shaped body; and said slot opening of said first slot facing radially outward of the ring-shaped body.

3. The grounding bushing of claim 2, comprising:

said second slot on said second end of said rotatable bushing portion parallel to the axial center of said ring-shaped body; and said slot opening of said second slot facing the bottom edge of said ring-shaped body.

4. The grounding bushing of claim 1, comprising:

said ring-shaped body including an inner periphery; and a tooth extending into said ring opening from said inner periphery of said stationary bushing portion.

5. The grounding bushing of claim 4, comprising:

a sloped upper surface on said tooth; and a sharp edge on said tooth, said sharp edge directed toward said ring opening.

6. The grounding bushing of claim 5, comprising:

a lip extending into said ring opening from said inner periphery of said stationary bushing portion; and said lip at the edge of said stationary bushing portion opposite said tooth.

7. The grounding bushing of claim 6, comprising a notch in said lip.

8. The grounding bushing of claim 7, comprising said notch in in axial alignment with the tooth along the axial center of said ring-shaped body.

9. The grounding bushing of claim 1, comprising said threaded bores on said stationary bushing portion including threaded bores on each end.

10. The grounding bushing of claim 6, comprising a liner to fit within said inner periphery of said ring-shaped body.

11. The grounding bushing of claim 10, comprising:

said liner including a top flange and a bottom flange defining a gap there between; and said liner held within said ring-shaped body by said lip of said bushing extending into said gap of said liner.

12. The grounding bushing of claim 11, comprising said top flange of said liner extends across said edges of said ring-shaped body.

13. The grounding bushing of claim 12, wherein said liner comprises two ends and a tab extending from a first of the ends and a notch on the opposing end of the liner, said tab of the mating liner to ride over the notch of the opposing line and cover the joints of the mated liners of the grounding bushing.

14. The grounding bushing of claim 1, comprising said ends of said bushing portions include planar mating surfaces.

15. The grounding bushing of claim 1, comprising:

an integral lug on at least one of said bushing portions, and a grounding conductor opening and a bore on said integral lug.

16. The grounding bushing of claim 15, comprising a screw to secure a grounding wire in said grounding conductor opening.

* * * * *